US012098715B2

(12) United States Patent
Lee et al.

(10) Patent No.: US 12,098,715 B2
(45) Date of Patent: Sep. 24, 2024

(54) LINEAR COMPRESSOR AND REFRIGERATOR INCLUDING SAME

(71) Applicant: LG Electronics Inc., Seoul (KR)

(72) Inventors: Jongwoo Lee, Seoul (KR); Gyeoungjin Jeon, Seoul (KR); Jonghun Ha, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/575,322

(22) Filed: Jan. 13, 2022

(65) Prior Publication Data

US 2022/0136492 A1 May 5, 2022

Related U.S. Application Data

(63) Continuation of application No. 16/243,724, filed on Jan. 9, 2019, now abandoned.

(30) Foreign Application Priority Data

Jan. 12, 2018 (KR) ..... 10-2018-0004497
Jan. 12, 2018 (KR) ..... 10-2018-0004523

(51) Int. Cl.
*F04B 39/00* (2006.01)
*F04B 35/04* (2006.01)
*F04B 53/00* (2006.01)

(52) U.S. Cl.
CPC ..... *F04B 39/0055* (2013.01); *F04B 35/045* (2013.01); *F04B 53/001* (2013.01); *F25B 2400/073* (2013.01); *F25B 2500/12* (2013.01)

(58) Field of Classification Search
CPC ..... F04B 35/045; F04B 39/0027; F04B 39/0055; F04B 39/0061; F04B 35/04; F04B 53/001; F25B 31/023; F25B 2400/073; F25B 2500/12
See application file for complete search history.

(56) References Cited

U.S. PATENT DOCUMENTS 3,608,666 A * 9/1971 Olsson ..... F01N 1/089 181/255
5,816,361 A 10/1998 Gerber
5,993,178 A 11/1999 Park et al.
(Continued)

FOREIGN PATENT DOCUMENTS

CN 108443116 8/2018
EP 2977611 1/2016
(Continued)

OTHER PUBLICATIONS

European Search Report in European Appln. No. 18211808.3, dated Feb. 27, 2019, 7 pages.
(Continued)

*Primary Examiner* — Devon C Kramer
*Assistant Examiner* — Chirag Jariwala
(74) *Attorney, Agent, or Firm* — Fish & Richardson P.C.

(57) ABSTRACT

The present disclosure relates to a linear compressor and a refrigerator including the same. A linear compressor according to the spirit of the present disclosure includes a shell, a cylinder, a piston and a muffler. And the muffler includes a plurality of flow tubes extending in a flow direction of the refrigerant, and a plurality of through-holes passing through at least one of the plurality of flow tubes.

19 Claims, 13 Drawing Sheets

(56) References Cited

U.S. PATENT DOCUMENTS

| | | | | |
|---|---|---|---|---|
| 6,341,663 | B1 | 1/2002 | Alex et al. | |
| 7,624,841 | B2 | 12/2009 | Bae et al. | |
| 2004/0247457 | A1 | 12/2004 | Kim et al. | |
| 2005/0142002 | A1 | 6/2005 | Kang et al. | |
| 2006/0060196 | A1 | 3/2006 | Kim | |
| 2009/0038329 | A1* | 2/2009 | Alvarenga | F04B 39/0066 62/296 |
| 2010/0260629 | A1* | 10/2010 | Kang et al. | F04B 39/0061 417/312 |
| 2011/0171046 | A1* | 7/2011 | Fagotti | F04B 39/0055 417/312 |
| 2015/0004014 | A1* | 1/2015 | Kim | F04B 35/045 417/312 |
| 2018/0187816 | A1* | 7/2018 | Masias | F16L 55/02718 |

FOREIGN PATENT DOCUMENTS

| | | | | |
|---|---|---|---|---|
| JP | 2016008610 | | 1/2016 | |
| KR | 100579578 | | 3/2006 | |
| KR | 20070073515 | | 8/2007 | |
| KR | 20080052786 | | 6/2008 | |
| KR | 100878606 | | 1/2009 | |
| KR | 20130112797 | | 10/2013 | |
| KR | 101334487 | | 11/2013 | |
| KR | 20150040027 | | 4/2015 | |
| KR | 20170124909 | | 11/2017 | |
| WO | WO2008082116 | | 7/2008 | |
| WO | WO-2008082116 | A2 * | 7/2008 | F04B 35/045 |

OTHER PUBLICATIONS

Extended European Search Report in European Appln. No. 21163430.8, dated Jul. 28, 2021, 4 pages.

* cited by examiner

LINEAR COMPRESSOR AND REFRIGERATOR INCLUDING SAME

CROSS-REFERENCE TO RELATED APPLICATIONS

The present application is a continuation of U.S. application Ser. No. 16/243,724, filed on Jan. 9, 2019, which claims priority under 35 U.S.C. 119 and 35 U.S.C. 365 to Korean Patent Application No. 10-2018-0004497, filed on Jan. 12, 2018 and Korean Patent Application No. 10-2018-0004523, filed on Jan. 12, 2018, the disclosures of which are hereby incorporated herein by reference in their entirety.

FIELD

The present disclosure relates to a linear compressor and a refrigerator including the same.

BACKGROUND

A refrigerator is a home appliance in which food may be stored in an internal storage chamber, which is shielded by a door, at a low temperature. A cooling system is provided in the refrigerator, so that the inside of the storage chamber is maintained at a temperature that is lower than an external temperature.

The cooling system, which is a system configured to circulate a refrigerant to generate cold air, repeatedly performs a compression process, a condensation process, an expansion process, and an evaporation process of the refrigerant. To achieve this, the cooling system includes a compressor, a condenser, an expansion device, and an evaporator.

In general, a compressor, which is a machine that receives power from a power generating device such as an electric motor and a turbine and increases pressure by compressing air, a refrigerant, or various other working fluids, has been widely used throughout the industry as well as in a home appliance such as the refrigerator.

The compressor is classified into a reciprocating compressor, a rotary compressor, and a scroll compressor according to a compression scheme for a working fluid.

In detail, the reciprocating compressor includes a cylinder and a piston provided inside the cylinder to linearly reciprocate. Further, a compression space is formed between a piston head and the cylinder, and as the compression space is increased/decreased by the linear reciprocating movement of the piston, a working fluid inside the compression space is compressed at a high temperature at a high pressure.

Further, the rotary compressor includes a cylinder and a roller eccentrically rotated inside the cylinder. Further, the roller is eccentrically rotated inside the cylinder to compress the working fluid supplied to the compression space at a high temperature at a high pressure.

Further, the scroll compressor includes a fixed scroll and an orbiting scroll rotating about the fixed scroll. Further, while being rotated, the orbiting scroll compresses the working fluid supplied to the compression space at a high temperature at a high pressure.

In recent years, among the reciprocating compressor, a linear compressor in which a piston is directly connected to a linearly reciprocating linear motor has been actively developed.

The linear compressor includes a linear motor allowing the piston to reciprocate. The linear motor is configured such that a permanent magnet is located between an inner stator and an outer stator, and the permanent magnet is driven to linearly reciprocate by a mutual electromagnetic force between the permanent magnet and the inner (or outer) stator. Further, as the permanent magnet is driven while being connected to the piston, the piston may reciprocate.

The piston linearly reciprocates in the cylinder inside a sealed shell to suction and compress the refrigerant. In detail, the piston moves from a top dead point to a bottom dead point so that the refrigerant is accommodated in a compression chamber, and the piston moves from the bottom dead point to the upper dead point so that the refrigerant accommodated in the compression chamber is compressed. In this case, as the pressure of suction gas flowing to the piston becomes higher, a suction valve may be opened more quickly, and a larger amount of the refrigerant may be accommodated in the compression chamber.

In relation to the linear compressor having the above-described structure, the applicant carried out and registered a patent (hereinafter, referred to as prior document 1).

<Prior document 1>

1. Registration No. 10-0579578 (Registration date: May 8, 2006)

2. Title of invention: Muffler of linear compressor

A muffler disposed inside the piston is disclosed in the prior document 1. The muffler serves as a passage through which noise according to flow of the refrigerant is reduced and the refrigerant suctioned into the compressor is moved to the piston.

According to the shape of the muffler disclosed in the prior document 1, the pressure of the suction gas flowing to the piston along the muffler is relatively lowered. When the pressure of the suction gas is lowered, the amount of the refrigerant accommodated in the compression chamber flows backward.

In particular, when the speed of the piston increases to increase cooling power of the compressor, a time point at which the suction valve is opened and a time point at which the pressure of the gas increases do not coincide with each other or the pressure of the suction gas is small. Thus, a smaller amount of the refrigerant may be accommodated in the compression chamber or the refrigerant may flow backward. Accordingly, efficiency of the compressor is reduced.

SUMMARY

The present disclosure is conceived to solve the above-described problems, and the present disclosure provides a linear compressor having a muffler, which is configured to increase the pressure of a refrigerant as compared to the related art, and a refrigerator including the same.

In particular, the present disclosure also provides a linear compressor having a muffler, the shape of which may be variously changed as the shapes of a plurality of components included in the muffler are changed, and a refrigerator including the same.

Further, the present disclosure also provides a linear compressor having increased cooling power and increased efficiency as a larger amount of a refrigerant is accommodated and compressed in a compression chamber as the pressure of the suctioned refrigerant increases, and a refrigerator including the same.

A linear compressor according to the spirit of the present disclosure may include a shell to which a suction pipe is coupled, a cylinder disposed inside the shell to define a compression space, a piston reciprocating inside the cylinder to compress a refrigerant in the compression space, and a muffler by which the refrigerant suctioned through the suction pipe flows to and is provided to the compression space, The muffler may include a plurality of flow tubes extending in a flow direction of the refrigerant, and a plurality of through-holes passing through at least one of the plurality of flow tubes.

In this case, the plurality of through-holes may have different sizes.

Further, the linear compressor according to the spirit of the present disclosure may include a muffler coupled to the piston and having an inlet through which the refrigerant is introduced and an outlet through which the refrigerant is discharged. The muffler includes a plurality of flow tubes extending from the inlet in the flow direction of the refrigerant toward the outlet. The plurality of flow tubes include a plurality of variable portions having a flow cross-sectional area widened in the flow direction.

According to the present disclosure, since the pressure of a refrigerant provided to a compression chamber is higher than that of the related art, a larger amount of the refrigerant is accommodated and compressed in the compression chamber, and accordingly, cooling power and efficiency of the compressor may be increased.

Further, even when the speed of the piston increases to increase the cooling power of the compressor, the pressure of the suctioned refrigerant may be secured, and thus responsiveness of a suction valve may be improved, and a sufficient amount of the refrigerant may be secured in the compression chamber.

In particular, the shape of a muffler through which the suctioned refrigerant flows is changed, so that the pressure of the suctioned refrigerant may be easily secured.

Further, the shapes of various configurations included in the muffler are changed so that the pressure of the suctioned refrigerant is secured. Thus, the muffler may be changed in various shapes.

Further, the size of the compressor including internal components is reduced so that the size of a machine room of a refrigerator may be reduced. Accordingly, an internal storage space of the refrigerator may increase.

BRIEF DESCRIPTION OF THE DRAWINGS

Embodiments will be described in detail with reference to the following drawings in which like reference numerals refer to like elements, and wherein.

DETAILED DESCRIPTION

Figure 1:
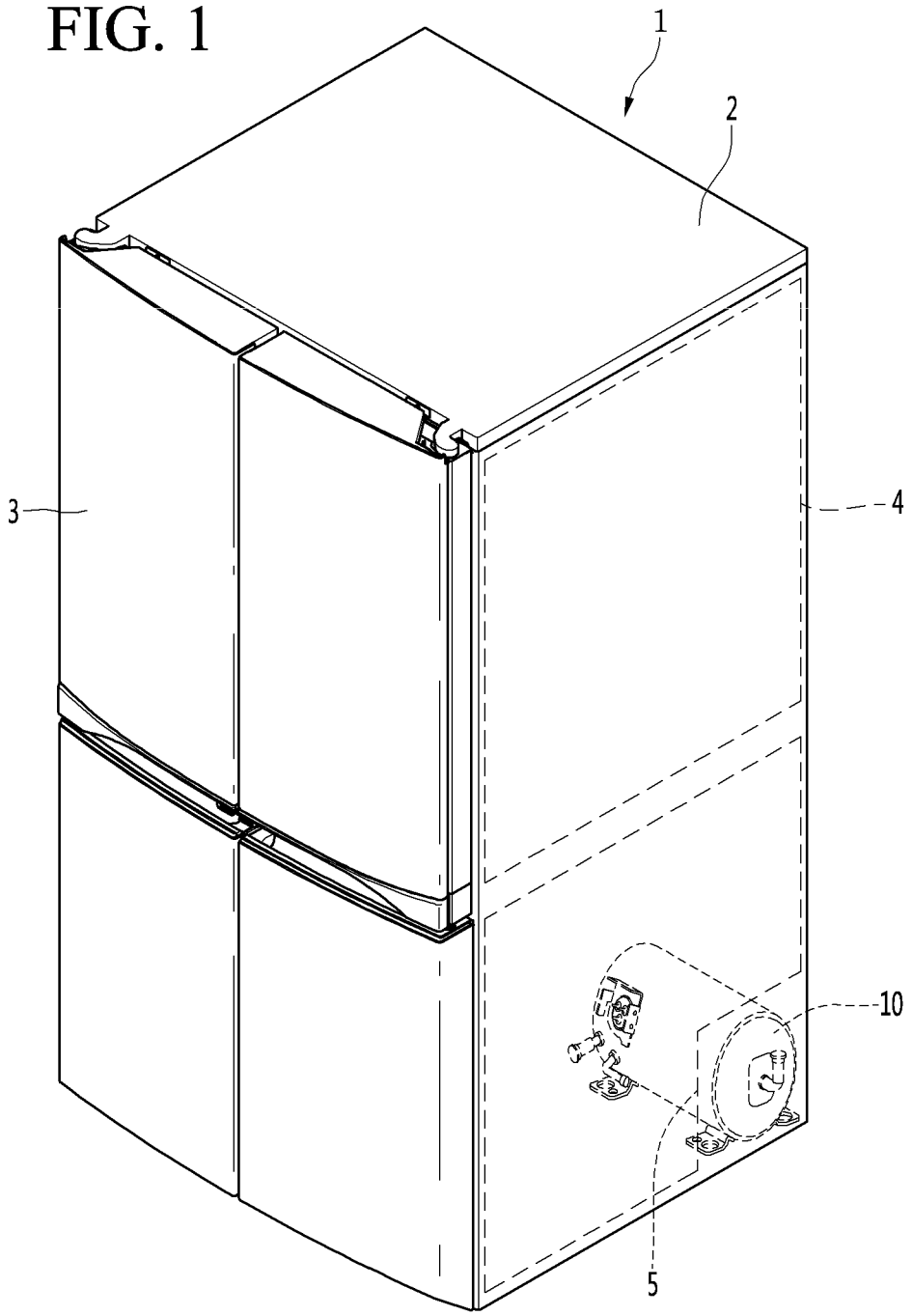
FIG. 1 is a view illustrating a refrigerator according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed description of a well-known configuration or function disturbs understanding of the embodiments of the present disclosure, the detailed description will be omitted.

Further, in the description of the embodiments of the present disclosure, the terms such as first, second, A, B, (a) and (b) may be used. Each of these terms is not used to delimit an essence, an order or a sequence of a corresponding component but used merely to distinguish the corresponding component from other component(s). It should be understood that when one component is "connected", "coupled" or "joined" to another component, the former may be directly connected or jointed to the latter or may be "connected", coupled" or "joined" to the latter with a third component interposed therebetween.

FIG. 1 is a view illustrating a refrigerator according to an embodiment of the present disclosure.

As illustrated in FIG. 1, a refrigerator according to the spirit of the present disclosure includes a cabinet 2 defining an outer appearance and at least one refrigerator door 3 coupled to the cabinet 2.

At least one storage chamber 4 is provided inside the cabinet 2. In this case, the refrigerator door 3 may be slidably or rotatably connected to the front surface of the cabinet 2 such that the storage chamber 4 is opened. In this case, the storage chamber 4 may include at least one of a refrigerator compartment and a freezer compartment, and the compartments may be partitioned by a partition wall.

Further, a machine room 5 in which a compressor 10 is disposed is provided inside the cabinet 2. As illustrated in FIG. 1, the machine room 5 may be generally disposed at a lower portion of a rear side of the cabinet 5.

In this case, performance and efficiency of the refrigerator 1 may be determined depending on performance and efficiency of the compressor 10. That is, when the performance and the efficiency of the compressor 10 are excellent, the amount of cold air, which is required for the storage chamber 4, may be supplied with smaller electric power.

Hereinafter, the compressor 10 having improved performance and improved efficiency according to the spirit of the present disclosure will be described in detail.

Figure 2:
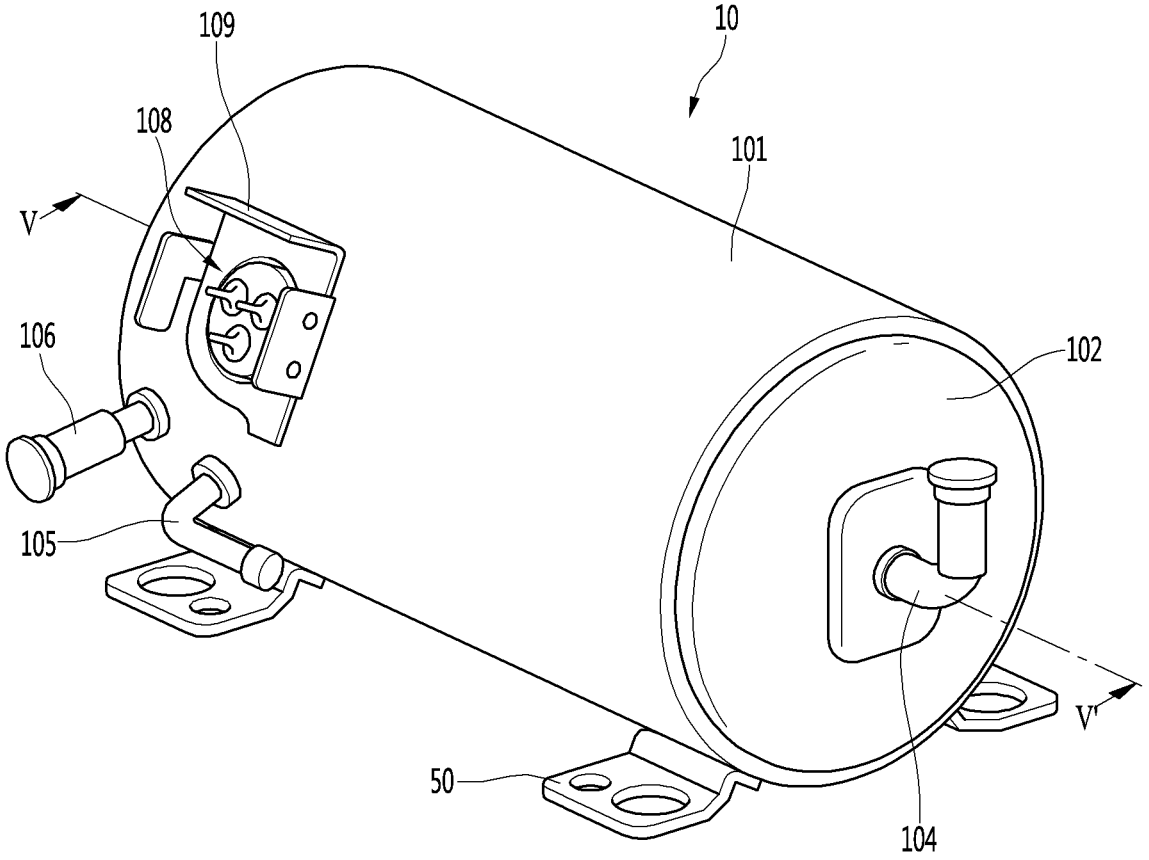
FIG. 2 is a view illustrating an outer appearance of a compressor according to the embodiment of the present disclosure.
Figure 3:
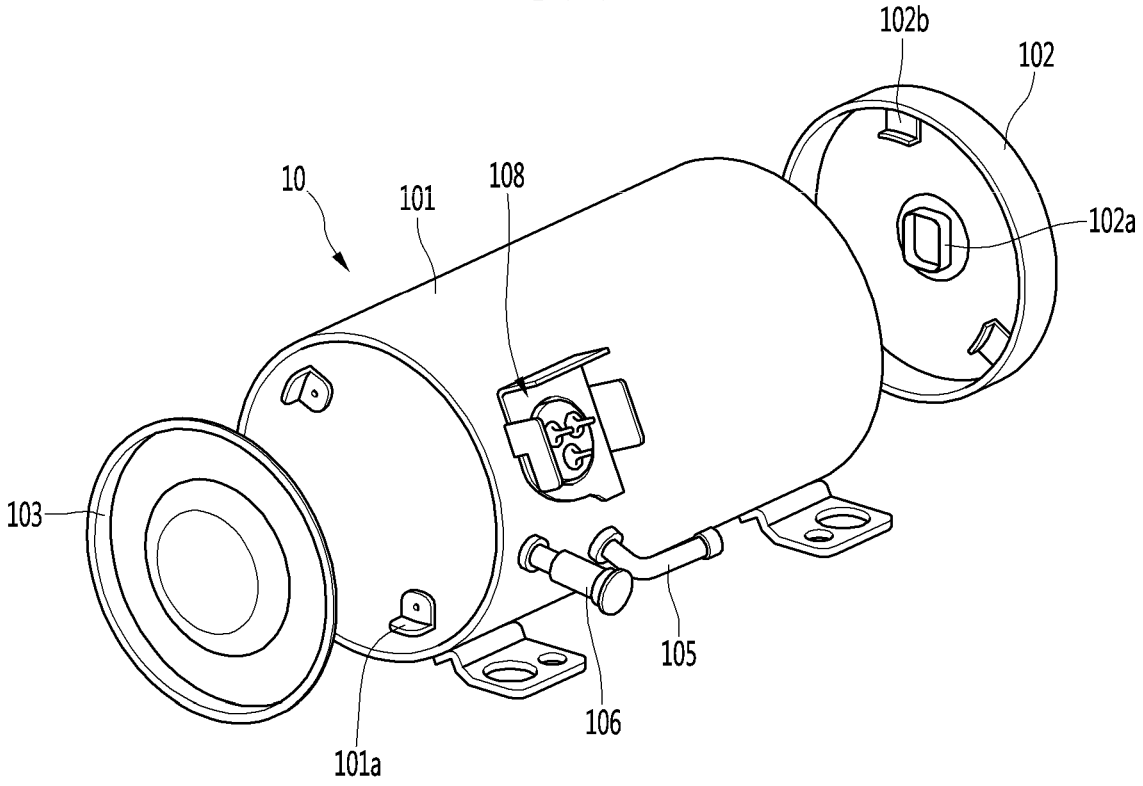
FIG. 3 is an exploded view illustrating a shell and a shell cover of the compressor according to the embodiment of the present disclosure.

FIG. 2 is a view illustrating an outer appearance of a compressor according to the embodiment of the present disclosure, and FIG. 3 is an exploded view illustrating a shell and a shell cover of the compressor according to the embodiment of the present disclosure.

Referring to FIGS. 2 and 3, the compressor 10 according to the spirit of the present disclosure includes a shell 101 and shell covers 102 and 103 coupled to the shell 101. In a broad sense, the shell covers 102 and 103 may be understood as one configuration of the shell 101.

Legs 50 may be coupled to a lower portion of the shell 101. The legs 50 may be coupled to a base of a product in which the compressor 10 is installed. That is, the legs 50 may be coupled to the above-described machine room 5 of the refrigerator 1.

The shell 101 may have an approximately cylindrical shape, and may be arranged to be laid transversely or axially. Based on FIG. 2, the shell 101 may transversely extend, and may have a slightly low height in a radial direction.

That is, there is an advantage in that since the compressor 10 may have a low height, when the compressor 10 is installed in the machine room 5 of the refrigerator 1, the height of the machine room 5 may be reduced. Accordingly, the volume of the storage chamber 4 may increase while the volume of the cabinet 2 is not changed.

A terminal 108 may be installed on an outer surface of the shell 101. The terminal 108 is understood as a configuration configured to transfer external power to a motor assembly 140 (see FIG. 4) of the linear compressor. In particular, the terminal 108 may be connected to a lead wire of a coil 141*c* (see FIG. 4).

A bracket 109 is installed outside the terminal 108. The bracket 109 may include a plurality of brackets surrounding the terminal 108. The bracket 109 may function to protect the terminal 108 from an external impact or the like.

Opposite sides of the shell 101 are opened. The shell covers 102 and 103 may be coupled to the opened opposite sides of the shell 101. In detail, the shell covers 102 and 103 include a first shell cover 102 coupled to one opened side of the shell 101 and a second shell cover 103 coupled to the opened other side of the shell 101. An inner space of the shell 101 may be sealed by the shell covers 102 and 103.

Based on FIG. 2, the first shell cover 102 may be located on a right side of the compressor 10, and the second shell cover 103 may be located on a left side of the compressor 10. In other words, the first and second shell covers 102 and 103 may be arranged to face each other.

The compressor 10 further includes a plurality of pipes 104, 105, and 106 provided in the shell 101 or the shell covers 102 and 103 to suction, discharge or inject a refrigerant.

The plurality of pipes 104, 105, and 106 include a suction pipe 104 through which the refrigerant is suctioned into the compressor 10, a discharge pipe 105 through which the compressed refrigerant is discharged from the compressor 10, and a process pipe 106 through which the refrigerant is supplemented to the compressor 10.

For example, the suction pipe 104 may be coupled to the first shell cover 102. The refrigerant may be suctioned into the compressor 10 along an axial direction through the suction pipe 104.

The discharge pipe 105 may be coupled to an outer circumferential surface of the shell 101. The refrigerant suctioned through the suction pipe 104 may be compressed while flowing in an axial direction. Further, the compressed refrigerant may be discharged through the discharge pipe 105. The discharge pipe 105 may be arranged to be closer to the second shell cover 103 than to the first shell cover 102.

The process pipe 106 may be coupled to an outer circumferential surface of the shell 101. A worker may inject the refrigerant into the compressor 10 through the process pipe 106.

The process pipe 106 may be coupled to the shell 101 at a height that is different from that of the discharge pipe 105, to avoid interference with the discharge pipe 105. The height is understood as a distance from the leg 50 in a vertical direction (or a radial direction). The discharge pipe 105 and the process pipe 106 are coupled to the outer circumferential surface of the shell 101 at different heights, so that work convenience may be achieved.

At least a portion of the second shell cover 103 may be located to be adjacent to an inner circumferential surface of the shell 101, which corresponds to a point where the process pipe 106 is coupled. In other words, at least a portion of the second shell cover 103 may act as resistance of the refrigerant injected through the process pipe 106.

Thus, in terms of a passage of the refrigerant, the size of the passage of the refrigerant introduced through the process pipe 106 is decreased toward the inner space of the shell by the second shell cover 103, and is increased in turns while passing through the inner space. In this process, because the pressure of the refrigerant is reduced, the refrigerant may be evaporated. Further, in this process, oil included in the refrigerant may be separated. Thus, the refrigerant from which the oil is separated is introduced into a piston 130 (see FIG. 4), so that compression performance of the refrigerant may be improved. The oil may be understood as working oil existing in a cooling system.

A cover support 102*a* is provided on an inner surface of the first shell cover 102. A second support device 185, which will be described below, may be coupled to the cover support 102*a*. The cover support 102*a* and the second support device 185 may be understood as components configured to support a body of the compressor 10. Here, the body of the compressor means a component provided inside the shell 101, and may include, for example, a driving part reciprocating in a front-rear direction and a support part configured to support the driving part.

The driving part may include the piston 130, a magnet frame 138, a permanent magnet 146, a supporter 137, a muffler 200, and the like, which will be described below. Further, the support part may include resonance springs 176*a* and 176*b*, a rear cover 170, a stator cover 149, a first support device 165, a second support device 185, and the like, which will be described below.

A stopper 102*b* may be provided on an inner surface of the first shell cover 102. The stopper 102*b* is understood as a configuration configured to prevent the body of the compressor, particularly, the motor assembly 140, from being damaged by collision with the shell 101 due to vibration or impact generated during transportation of the compressor 10. The stopper 102*b* is located to be adjacent to the rear cover 170, which will be described below, and when the compressor 10 is shaken, the rear cover 170 interferes with the stopper 102*b*, so that an impact may be prevented from being transferred to the motor assembly 140.

Spring fastened parts 101*a* may be provided on an inner circumferential surface of the shell 101. For example, the spring fastened parts 101*a* may be arranged to be adjacent to the second shell cover 103. The spring fastened parts 101*a* may be coupled to a first support spring 166 of the first support device 165, which will be described below. As the spring fastened parts 101*a* and the first support device 165 are coupled to each other, the body of the compressor may be stably supported on an inner side of the shell 101.

Figure 4:
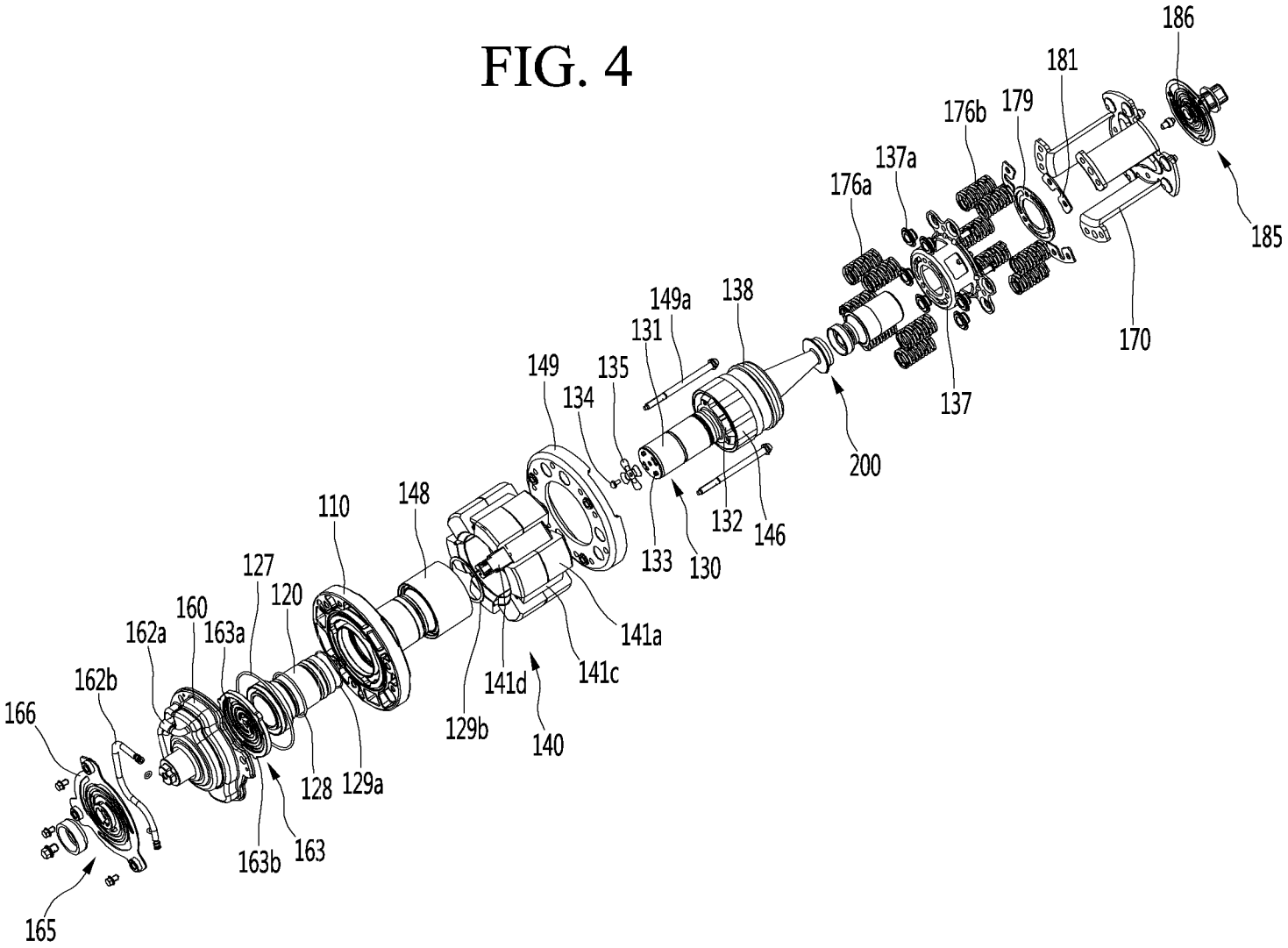
FIG. 4 is an exploded perspective view illustrating a configuration of the compressor according to the embodiment of the present disclosure.
Figure 5:
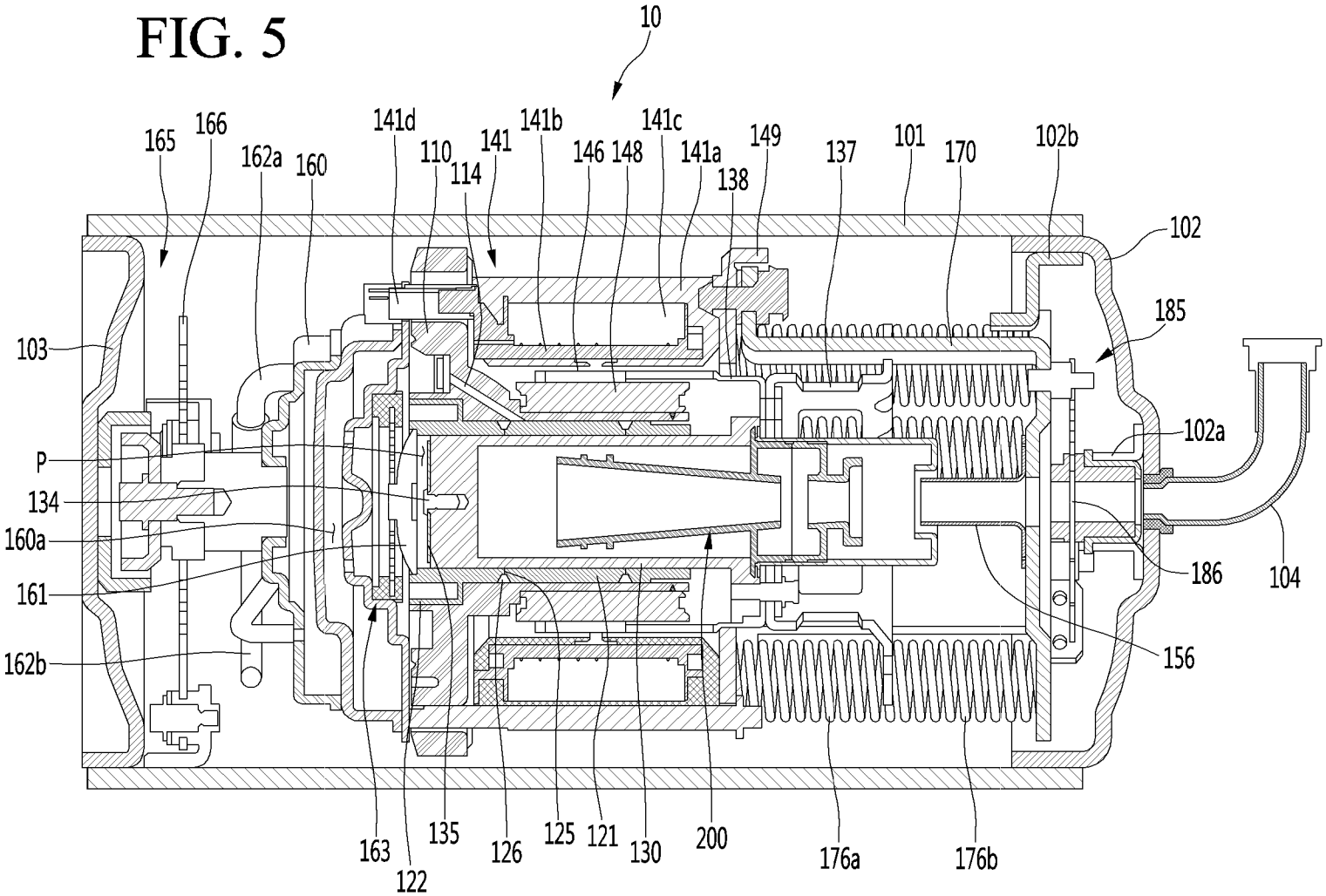
FIG. 5 is a sectional view taken along line V-V' of FIG. 2.

FIG. 4 is an exploded perspective view illustrating a configuration of the compressor according to the embodiment of the present disclosure, and FIG. 5 is a sectional view taken along line V-V' of FIG. 2.

Referring to FIGS. 4 and 5, the compressor 10 according to the embodiment of the present disclosure includes a cylinder 120 provided inside the shell 101, the piston 130 linearly reciprocating inside the cylinder 120, and the motor assembly 140 serving as a linear motor configured to provide a driving force to the piston 130. When the motor assembly 140 is driven, the piston 130 may reciprocate in an axial direction.

The compressor 10 further includes the muffler 200 connected to the piston 130 and configured to reduce noise generated by the refrigerant suctioned through the suction pipe 104. The refrigerant suctioned through the suction pipe 104 flows into the piston 130 via the muffler 200.

For example, while the refrigerant passes through the muffler 200, flow noise of the refrigerant may be reduced. Further, the muffler 200 may be provided in various shapes to adjust the pressure of the refrigerant passing through the muffler 200. The various shapes of the muffler will be described below in detail.

Hereinafter, for convenience of description, directions will be defined.

An "axial direction" may be understood as a direction in which the piston 130 reciprocates, that is, a transverse direction in FIG. 5. Further, in the "axial direction", a direction from the suction pipe 104 to a compression space P, that is, a direction in which the refrigerant flows, is defined as a "forward direction", and a direction that is opposite thereto is defined as a "rearward direction". For example, when the piston 130 is moved in the front direction, the compression space P may be compressed.

On the other hand, a "radial direction" may be understood as a direction that is perpendicular to the direction in which the piston 130 reciprocates, that is, a vertical direction in FIG. 5.

The piston 130 includes an approximately cylindrical piston body 131 and a piston flange 132 extending from the piston body 131 in the radial direction. The piston body 131 may reciprocate inside the cylinder 120, and the piston flange 132 may reciprocate outside the cylinder 120.

The cylinder 120 is configured to accommodate at least a part of the muffler 150 and at least a part of the piston body 131.

A compression space P in which the refrigerant is compressed by the piston 130 is formed inside the cylinder 120. Further, suction holes 133 through which the refrigerant is introduced into the compression space P are formed on a front surface of the piston body 131, and a suction valve 135 configured to open/close the suction holes 133 is provided on the front side of the suction holes 133.

Further, the compressor includes a discharge cover 160 and discharge valve assemblies 161 and 163. The discharge cover 160 is installed on the front side of the compression space P, and defines a discharge space 160*a* for the refrigerant discharged from the compression space P. The discharge space 160*a* includes a plurality of space portions partitioned by an inner wall of the discharge cover 160. The plurality of space portions may be arranged in a front-rear direction, and may communicate with each other.

The discharge valve assemblies 161 and 163 are coupled to the discharge cover 160, and selectively discharge the refrigerant compressed in the compression space P. The discharge valve assemblies 161 and 163 include a discharge valve 161 which is, when the pressure of the compression space P is not less than a discharge pressure, opened to introduce the refrigerant into the discharge space 160*a*, and a spring assembly 163, which is provided between the discharge valve 161 and the discharge cover 160 to provide an elastic force in the axial direction.

The spring assembly 163 includes a valve spring 163*a* and a spring support 163*b* configured to support the valve spring 163*a* on the discharge cover 160. For example, the valve spring 163*a* may include a leaf spring. Further, the spring support 163*b* may be injection-molded integrally with the valve spring 153*a* through an injection molding process.

The discharge valve 161 is coupled to the valve spring 163*a*, and a rear side or a rear surface of the discharge valve 161 is located to be supported on the front surface of the cylinder 120. When the discharge valve 161 is supported on the front surface of the cylinder 120, the compression space P maintains a sealed state, and when the discharge valve 161 is spaced apart from the front surface of the cylinder 120, the compression space P is opened, so that the compressed refrigerant inside the compression space P may be discharged.

That is, the compression space P is understood as a space formed between the suction valve 135 and the discharge valve 161. Further, the suction valve 135 may be formed on one side of the compression space P, and the discharge valve 161 may be provided on the other side of the compression space P, that is, on a side that is opposite to the suction valve 135.

While the piston 130 linearly reciprocates inside the cylinder 120, when the pressure of the compression space P is not more than a suction pressure, the suction valve 135 is opened, so that the refrigerant is suctioned into the compression space P. On the other hand, when the pressure of the compression space P is not less than the suction pressure, in a state in which the suction valve 135 is closed, the refrigerant of the compression space P is compressed.

Meanwhile, when the pressure of the compression space P is not less than the discharge pressure, the valve spring 163*a* is deformed to the front side to open the discharge valve 161, and the refrigerant is discharged from the compression space P to a discharge space of the discharge cover 160. When the refrigerant is completely discharged, the valve spring 163*a* provides a restoring force to the discharge valve 161, so that the discharge valve 161 is closed.

Further, a cover pipe 162*a* is coupled to the discharge cover 160 such that the refrigerant flowing in the discharge space 160*a* of the discharge cover 160 is discharged. For example, the cover pipe 162*a* may be made of metal.

Further, a loop pipe 162*b* is further coupled to the cover pipe 162*a* such that the refrigerant flowing through the cover pipe 162*a* is transferred to the discharge pipe 105. One side of the loop pipe 162*b* may be coupled to the cover pipe 162*a*, and the other side of the loop pipe 162*b* may be coupled to the discharge pipe 105.

The loop pipe 162*b* may be made of a flexible material, and may be formed to be relatively long. Further, the loop pipe 162*b* may extend from the cover pipe 162*a* along the inner circumferential surface of the shell 101 to be rounded, and may be coupled to the discharge pipe 105. For example, the loop pipe 162*b* may have a wound shape.

The compressor 10 further includes a frame 110. The frame 110 is understood as a configuration configured to fix the cylinder 120. For example, the cylinder 120 may be press-fitted into the frame 110. The cylinder 120 and the frame 110 may be made of aluminum or aluminum alloy.

The frame 110 is arranged to surround the cylinder 120. That is, the cylinder 120 may be located to be accommodated inside the frame 110. Further, the discharge cover 160 may be coupled to a front surface of the frame 110 through a fastening member.

The motor assembly 140 includes an outer stator 141 fixed to the frame 110 and arranged to surround the cylinder 120, an inner stator 148 spaced apart from an inner side of the outer stator 141, and the permanent magnet 146 located in a space between the outer stator 141 and the inner stator 148.

The permanent magnet 146 may linearly reciprocate by a mutual electromagnetic force of the outer stator 141 and the inner stator 148. Further, the permanent magnet 146 may be configured as a single magnet having one pole or may be configured by coupling a plurality of magnets having three poles.

The permanent magnet 146 may be installed in the magnet frame 138. The magnet frame 138 may have an approximately cylindrical shape, and may be inserted into a space between the outer stator 141 and the inner stator 148.

In detail, based on the sectional view of FIG. 5, the magnet frame 138 may be coupled to the piston flange 132 to extend in an outward radial direction and to be bent in the front direction. The permanent magnet 146 may be installed on a front side of the magnet frame 138. Accordingly, when the permanent magnet 146 reciprocates, the piston 130 may reciprocate in the axial direction together with the permanent magnet 146.

The outer stator 141 includes coil wound bodies 141*b*, 141*c*, and 141*d*, and a stator core 141*a*. The coil wound bodies 141*b*, 141*c*, and 141*d* include a bobbin 141*b* and a coil 141*c* wound in a circumferential direction of the bobbin 141*b*. Further, the coil wound bodies 141*b*, 141*c*, and 141*d* further include a terminal 141*d* configured to guide a power line connected to the coil 141*c* such that the power line is withdrawn or exposed to the outside of the outer stator 141. The terminal 141*d* may be arranged to be inserted into a terminal insertion part provided in the frame 110.

The stator core 141*a* includes a plurality of core blocks configured by stacking a plurality of laminations in a circumferential direction. The plurality of core blocks may be arranged to surround at least a part of the coil wound bodies 141*b*, 141*b* and 141*c*.

A stator cover 149 is provided on one side of the outer stator 141. That is, one side of the outer stator 141 may be supported by the frame 110, and the other side of the outer stator 141 may be supported by the stator cover 149.

The stator cover 149 and the frame 110 are fastened to each other through a cover fastening member 149*a*. The cover fastening member 149*a* may pass through the stator cover 149 to extend toward the frame 110 in the front direction, and may be coupled to a fastening hole provided in the frame 110.

The inner stator 148 is fixed to an outer circumference of the frame 110. Further, the inner stator 148 is configured by stacking a plurality of laminations on an outer side of the frame 110 in the circumferential direction.

The compressor 10 further includes the supporter 137 configured to support the piston 130. The supporter 137 may be coupled to a rear portion of the piston 130, and the suction muffler 200 may be arranged inside the supporter 137 to pass through the supporter 137. The piston flange 132, the magnet frame 138, and the supporter 137 may be fastened to each other through a fastening member.

A balance weight 179 may be coupled to the supporter 137. The weight of the balance weight 179 may be determined based on a range of an operating frequency of the body of the compressor.

The compressor 10 further includes a rear cover 170 coupled to the stator cover 149 to extend rearward, and supported by the second support device 185.

In detail, the rear cover 170 includes three support legs, and the three support legs may be coupled to a rear surface of the stator cover 149. A spacer 181 may be interposed between the three support legs and the stator cover 149. A distance between the stator cover 149 and a rear end of the rear cover 170 may be determined by adjusting the thickness of the spacer 181. Further, the rear cover 170 may be spring-supported on the supporter 137.

The compressor 10 further includes an inlet guide 156 coupled to the rear cover 170 to guide introduction of the refrigerant into the muffler 200. At least a part of the inlet guide 156 may be inserted into the muffler 200.

The compressor 10 further includes the plurality of resonance springs 176*a* and 176*b* having natural frequencies which are adjusted such that the piston 130 may resonate.

The plurality of resonance springs 176*a* and 176*b* include a first resonance spring 176*a* supported between the supporter 137 and the stator cover 149, and a second resonance spring 176*b* supported between the supporter 137 and the rear cover 170. Stable movement of the driving part reciprocating inside the compressor 10 may be performed by the action of the plurality of resonance springs 176*a* and 176*b*, and the amount of vibration or noise generated due to the movement of the driving part may be reduced.

The supporter 137 includes a first spring support 137*a* coupled to the first resonance spring 176*a*.

The compressor 10 includes the frame 110 and a plurality of sealing members 127, 128, 129*a*, and 129*b* for increasing coupling force between components near the frame 110.

In detail, the plurality of sealing members 127, 128, 129*a*, and 129*b* include a first sealing member 127 provided at a portion where the frame 110 and the discharge cover 160 are coupled to each other. The first sealing member 127 may be arranged at a first installation groove of the frame 110.

The plurality of sealing members 127, 128, 129*a*, and 129*b* include a second sealing member 128 provided at a portion where the frame 110 and the cylinder 120 are coupled to each other. The second sealing member 128 may be arranged at a second installation groove of the frame 110.

The plurality of sealing members 127, 128, 129*a*, and 129*b* include a third sealing member 129*a* provided between the cylinder 120 and the frame 110. The third sealing member 129*a* may be arranged at a cylinder groove formed on a rear side of the cylinder 120. The third sealing member 129*a* may function to prevent the refrigerant in a gas pocket formed between an inner circumferential surface of the frame and an outer circumferential surface of the cylinder from being leaked to the outside, thereby increasing a coupling force between the frame 110 and the cylinder 120.

The plurality of sealing members 127, 128, 129*a*, and 129*b* include a fourth sealing member 129*b* provided at a portion where the frame 110 and the inner stator 148 are coupled to each other. The fourth sealing member 129*b* may be arranged at a third installation groove of the frame 110. The first to fourth sealing members 127, 128, 129*a*, and 129*b* may have a ring shape.

The compressor 10 further includes the first support device 165 coupled to the discharge cover 160 to support one side of the body of the compressor 10. The first support device 165 may be arranged to be adjacent to the second shell cover 103 to elastically support the body of the compressor 10. In detail, the first support device 165 includes the first support spring 166. The first support spring 166 may be coupled to the spring fastened parts 101*a* which has been described in FIG. 3.

The compressor 10 further includes the second support device 185 coupled to the rear cover 170 to support the other side of the body of the compressor 10. The second support device 185 may be coupled to the first shell cover 102 to elastically support the body of the compressor 10. In detail, the second support device 185 includes the second support spring 186. The second support spring 186 may be coupled to the cover support 102*a* which has been described in FIG. 3.

The cylinder 120 includes a cylinder body 121 extending in the axial direction and a cylinder flange 122 provided on an outer side of a front side of the cylinder body 121. The cylinder body 121 has a cylindrical shape having an axial central axis, and is inserted into the frame 110. Thus, the outer circumferential surface of the cylinder body 121 may be located to face the inner circumferential surface of the frame 110.

A gas inlet 126 into which at least a portion of the refrigerant discharged through the discharge valve 161 is introduced is formed in the cylinder body 121. The at least a portion of the refrigerant is understood as a refrigerant used as a gas bearing between the piston 130 and the cylinder 120.

As illustrated in FIG. 5, the refrigerant used as a gas bearing flows to the gas pocket formed between the inner circumferential surface of the frame 110 and the outer circumferential surface of the cylinder 120 via a gas hole 114 formed in the frame 110. Further, the refrigerant in the gas pocket may flow to the gas inlet 126.

In detail, the gas inlet 126 may be recessed radially inward from the outer circumferential surface of the cylinder body 121. Further, the gas inlet 126 may have a circular shape along the outer circumferential surface of the cylinder body 121 with respect to an axial central axis. The gas inlet 126 may be provided in plurality. For example, the number of the gas inlets 126 may be two.

The cylinder body 121 includes a cylinder nozzle 125 extending radially inward from the gas inlet 126. The cylinder nozzle 125 may extend to the inner circumferential surface of the cylinder body 121.

The refrigerant having passed through the gas inlet 126 is introduced into a space between the inner circumferential surface of the cylinder body 121 and the outer circumferential surface of the piston body 131 through the cylinder nozzle 125. Such a refrigerant provides a lifting force to the piston 130 to function as a gas bearing for the piston 130.

Figure 6:
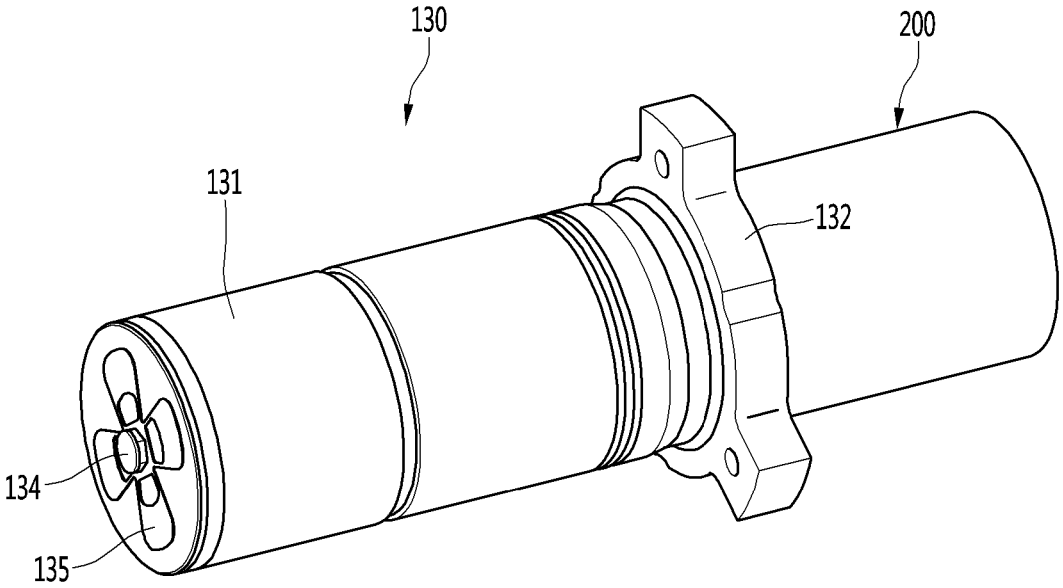
FIG. 6 is a view illustrating a piston and a muffler of the compressor according to a first embodiment of the present disclosure.
Figure 7:
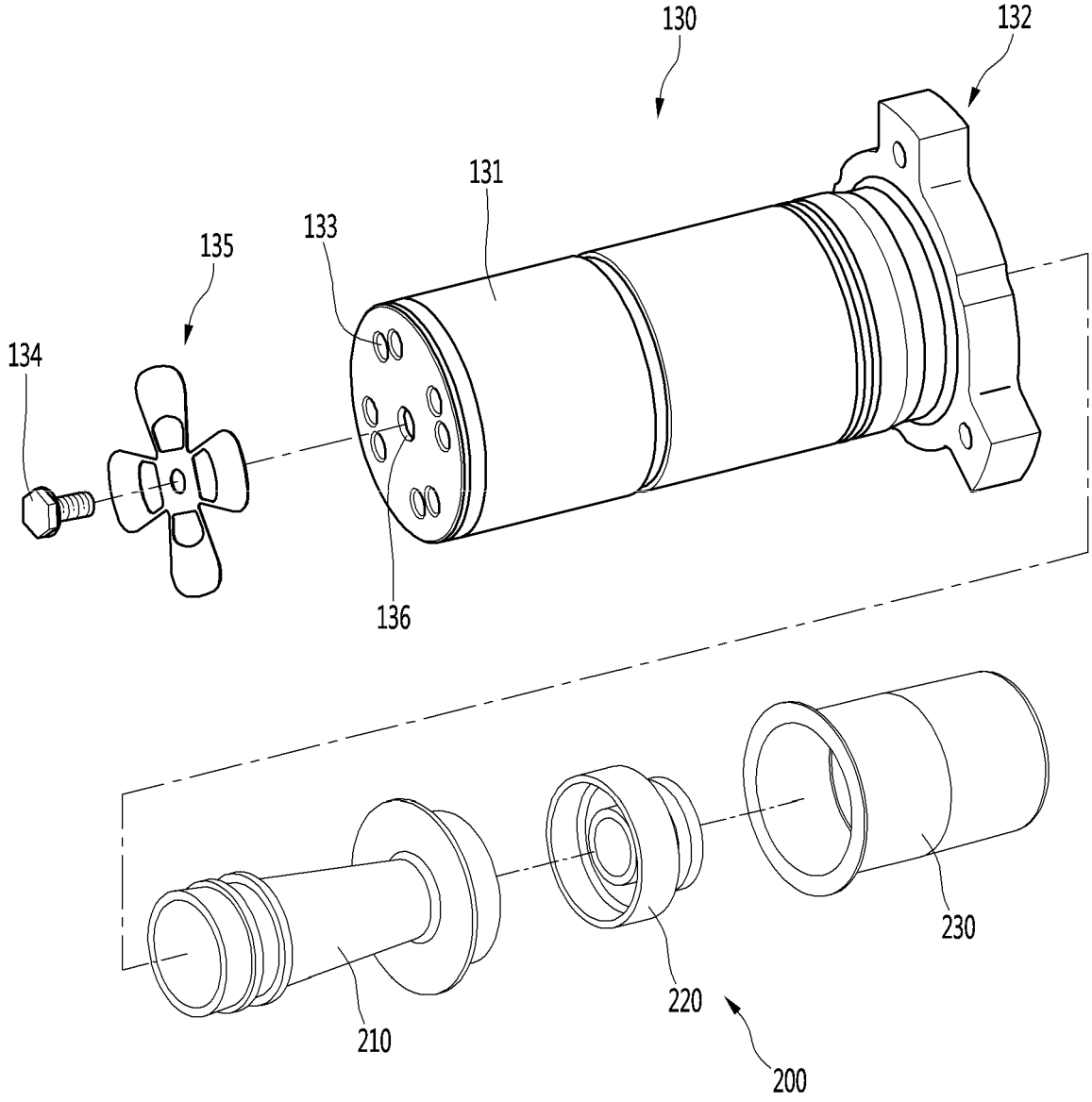
FIG. 7 is an exploded view illustrating the piston and the muffler of the compressor according to the first embodiment of the present disclosure.

FIG. 6 is a view illustrating a piston and a muffler of the compressor according to a first embodiment of the present disclosure, and FIG. 7 is an exploded view illustrating the piston and the muffler of the compressor according to the first embodiment of the present disclosure.

As illustrated in FIGS. 6 and 7, the liner compressor according to the spirit of the present disclosure includes a piston having a suction hole 133 through which a refrigerant is suctioned into a compression space P and a suction valve 135 disposed on one side of the piston 130 to open/close the suction hole 133. Further, the linear compressor further includes a valve fastening member 134 coupled to the piston 130 such that the suction valve 135 is fastened to the piston 130.

Further, a fastening hole 136 to which the valve fastening member 134 is fastened is formed in the piston 130. In this case, the valve fastening member 134 passes through the suction valve 135 to be coupled to the fastening hole 136. Accordingly, a central side of the suction valve 135 is fixed to the piston 130 through the valve fastening member 134.

Further, as an edge of the suction valve 135 is bent forward, the suction hole 133 may be opened. Further, as an edge of the suction valve 135 returns to the rear side, the suction hole 133 may be closed.

Such movement of the suction valve 135 is determined based on pressure. That is, when the pressure of a rear end of the suction valve 135 is higher than the pressure of a front end of the suction valve 135, the suction hole 133 is opened, and when the pressure of the front end of the suction valve 135 is higher than the pressure of the rear end of the suction valve 135, the suction hole 133 is closed. In this case, when the suction valve 135 more quickly moves forward, a larger amount of the refrigerant may flow to the compression space P through the suction hole 133.

That is, when the pressure of the rear end of the suction valve 135, that is, the pressure of the refrigerant accommodated inside the piston 130, is high, a larger amount of the refrigerant may flow through the suction hole 133. The pressure of the refrigerant may be adjusted by a muffler 200 accommodated inside the piston 130.

As illustrated in FIGS. 6 and 7, the linear compressor according to the spirit of the present disclosure includes the muffler 200 configured by a plurality of components coupled to each other. In this case, for convenience of description, the plurality of components are classified into a first muffler 210, a second muffler 220, and a third muffler 230.

The first muffler 210 is located inside the piston 130, and the second muffler 220 is coupled to a rear portion of the first muffler 210. Further, the third muffler 230 may accommodate the second muffler 220 therein, and may extend to the rear side of the first muffler 210.

Further, a muffler filter (not illustrated) may be located on a boundary surface on which the first muffler 210 and the second muffler 220 are coupled to each other. For example, the muffler filter may have a circular shape, and an outer circumference of the muffler filter may be supported between the first and second mufflers 210 and 220.

In terms of a flow direction of the refrigerant, the refrigerant suctioned through the suction pipe 104 may sequentially pass through the third muffler 230, the second muffler 220, and the first muffler 210. In this process, the flow noise of the refrigerant may be reduced, and the pressure may increase.

In this case, the muffler 200 has at least one variable portion having a flow cross-sectional area a flow direction of the refrigerant. In detail, the flow cross-sectional area of the variable portion is gradually widened in a flow direction of the refrigerant.

That is, the muffler 200 is provided in a shape in which as a cross sectional area in which the refrigerant flows by the Bernoulli's equation is gradually widened, the flow rate of the refrigerant is reduced, and thus the pressure of the refrigerant increases. Accordingly, the pressure of the refrigerant may become higher, the suction valve 135 may be bent more quickly, and the larger amount of the refrigerant may flow to the suction hole 133.

Further, the muffler 200 according to the spirit of the present disclosure has a plurality of variable portions. That is, the plurality of variable portions have a flow cross sectional areas gradually widened in the flow direction of the refrigerant. Hereinafter, an exemplary shape of the muffler 200 according to the present disclosure will be described with reference to the accompanying drawings.

Figure 8:
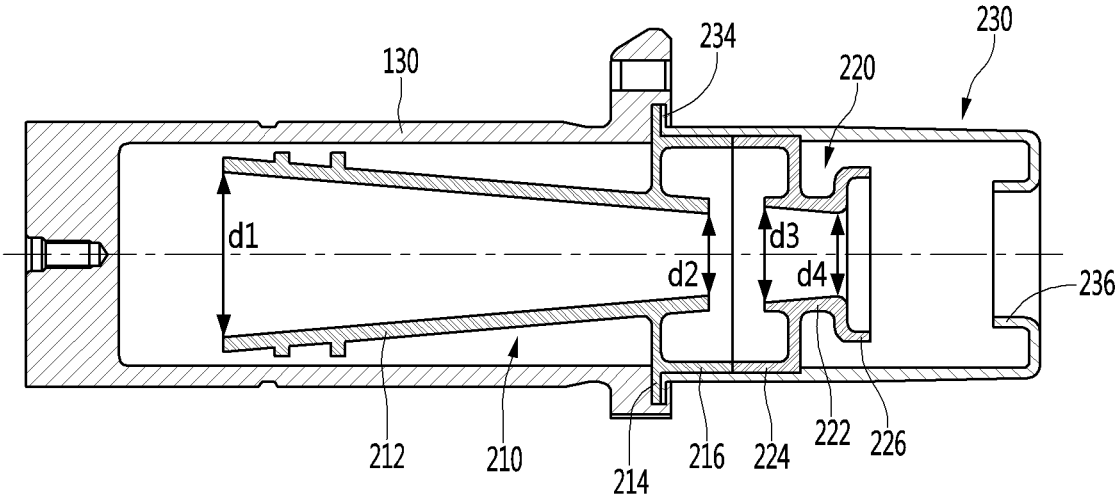
FIG. 8 is a sectional view illustrating the piston and the muffler of the compressor according to the first embodiment of the present disclosure.

FIG. 8 is a sectional view illustrating the piston and the muffler of the compressor according to the first embodiment of the present disclosure. For convenience of description, the piston is simply illustrated in FIG. 8.

As illustrated in FIG. 8, the muffler according to the first embodiment of the present disclosure is provided with a plurality of variable portions. In this case, the plurality of variable portions may be formed in the plurality of mufflers constituting the muffler 200, respectively.

Referring to FIG. 8, the first muffler 210 has a first flow tube 212 through which the refrigerant flows, a first coupling portion 214 seated on the piston 130, and a first suction portion 216 in contact with the second muffler 220.

The first flow tube 212 is provided in a circular tube extending in a flow direction of the refrigerant. Hereinafter, with respect to the flow direction of the refrigerant, one end of the first flow tube 212, which is adjacent to the second muffler 220, is named an inlet, and the other end of the first flow tube 212, which is adjacent to a front end of the piston 130, is named an outlet.

In this case, the diameter d2 of the inlet of the first flow tube 212 differs from the diameter d1 of the outlet of the first flow tube 212. In particular, the diameter d2 of the inlet of the first flow tube 212 is smaller than the diameter d1 of the outlet of the first flow tube 212. Accordingly, the first flow tube 212 has a variable portion extending from the inlet to the outlet. Further, the outer side and the inner side of the first flow tube 212 have an inclined structure extending from the inlet to the outlet.

The first coupling part 214 may extend from the outside of the first flow tube 212 radially beyond the inner diameter of the piston 130 and may be seated on one end of the piston 130. That is, the first coupling part 214 is formed at a position corresponding to the one end of the piston 130. In this case, a predetermined groove corresponding to the first coupling part 214 may be provided at one end of the piston 130.

Thus, with respect to the first coupling part 214, a front portion of the first flow tube 212 including the outlet may be disposed inside the piston 130. Further, the diameter d1 of the outlet of the first flow tube 212 is smaller than the inner diameter of the piston 130.

The first suction portion 216 may extend from the first coupling portion 214 rearward beyond the first flow tube 212 to be in contact with one end of the second muffler 220. In this case, the first suction portion 216 may extend rearward beyond the piston 130. Further, the third muffler 230 is disposed outside the first suction portion 216.

Referring to FIG. 8, the second muffler 220 has a second flow tube 222 through which the refrigerant flows, a second coupling portion 224 extending from the second flow tube 222 to one side, and a second suction portion 226.

The second flow tube 222 is provided in a circular tube extending in the flow direction of the refrigerant. Hereinafter, with respect to the flow direction of the refrigerant, one end of the second flow tube 222, which is adjacent to the first muffler 210, is named an outlet, and the other end of the second flow tube 222 is named an inlet.

In this case, the diameter d4 of the inlet of the second flow tube 222 differs from the diameter d3 of the outlet of the second flow tube 212. In particular, the diameter d4 of the inlet of the second flow tube 222 is smaller than the diameter d3 of the outlet of the second flow tube 222. Accordingly, the second flow tube 222 has a variable portion extending from the inlet to the outlet. Further, the outer side and the inner side of the second flow tube 222 have an inclined structure extending from the inlet to the outlet.

The second coupling portion 224 extends radially and forward from the outside of the second flow tube 222 to be in contact with the first suction portion 216 of the first muffler 210. In this case, the second coupling portion 224 extends forward beyond the second flow tube 222. That is, one end of the first suction portion 216 may be in contact with one end of the second coupling portion 224, and the diameter of the first suction portion 216 may correspond to the diameter of the second coupling portion 224. Further, the third muffler 230 is disposed outside the second suction portion 224.

The second suction portion 226 extends radially and rearward from the second flow tube 222. That is, with respect to the second flow tube 222, the second coupling portion 224 is located on the front side and the second suction portion 226 may be located on the rear side.

Referring to FIG. 8, a third suction portion 236 through which the refrigerant is suctioned and a third coupling portion 234 coupled to the piston 130 are provided in the third muffler 230.

Referring to FIG. 5, at least a part of the above-described inlet guide 156 may be inserted into and disposed in the third suction portion 236. Thus, the third suction portion 236 may be provided to have a shape corresponding to the inlet guide 156.

The third coupling portion 234 may overlap with the first coupling portion 214 and may be seated on one end of the piston 130. Further, as the piston 130 and the supporter 137 are coupled to each other, the first coupling portion 214 and the third coupling portion 234 may be fixed.

The first flow tube 212 and the second flow tube 222 extend in a flow direction of the suctioned refrigerant with respect to the same central axis. Further, the second flow tube 222 is spaced apart from the first flow tube 212 by a predetermined distance. That is, the inlet of the first flow tube 212 is spaced apart from the outlet of the second flow tube 222.

Further, the diameter d3 of the outlet of the second flow tube 222 may be smaller than the diameter d2 of the inlet of the first flow tube 212. That is, the diameter d4 of the inlet of the second flow tube 222, the diameter d3 of the outlet of the second flow tube 222, the diameter d2 of the inlet of the first flow tube 212, and the diameter d1 of the outlet of the first flow tube 212 may sequentially increase ($d1>d2>d3>d4$).

In description of flow of the refrigerant in the muffler 200 having the above-described structure, the refrigerant introduced into the third muffler 230 passes through the second flow tube 222. That is, the refrigerant flows from the inlet to the outlet of the second flow tube 222, and as the diameter increases gradually, the flow rate decreases and the pressure increases.

Further, the refrigerant passes through the first flow tube 212 to flow to a front end of the piston 130. In this case, the refrigerant flows from the inlet to the outlet of the second flow tube 212, and as the diameter increases gradually, the flow rate decreases and the pressure increases.

The refrigerant may flow to the front end of the piston 130 along such a variable portion at a higher pressure. Accordingly, the suction valve 135 may be opened more quickly and a larger amount of the refrigerant may be introduced into the compression chamber.

Further, the muffler 200 may be provided in various forms having a plurality of variable portions. Hereinafter, another exemplary shape of the muffler 200 according to the present disclosure will be described with reference to the accompanying drawings.

Figure 9:
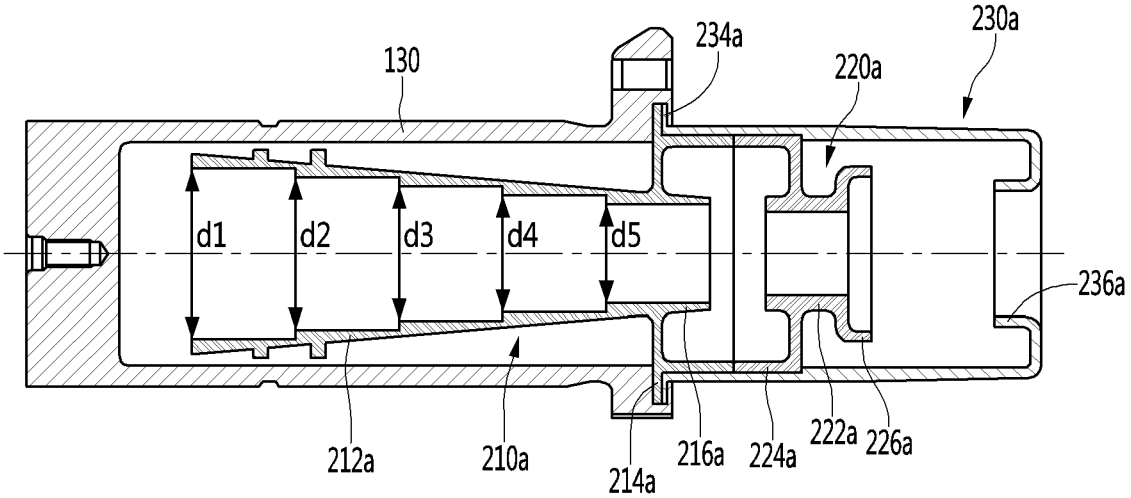
FIG. 9 is a sectional view illustrating a piston and a muffler of a compressor according to a second embodiment of the present disclosure.

FIG. 9 is a sectional view illustrating a piston and a muffler of a compressor according to a second embodiment of the present disclosure. The same contents as the above description will be omitted and the above description will be cited.

As illustrated in FIG. 9, the muffler according to the second embodiment of the present disclosure is provided with a plurality of variable portions. In this case, the plurality of variable portions may be formed in the first muffler 210*a* constituting the muffler 200.

Referring to FIG. 9, the first muffler 210*a* has a first flow tube 212*a* through which the refrigerant flows, a first coupling portion 214*a* seated on the piston 130*a*, and a first suction portion 216*a* in contact with the second muffler 220*a*.

The first flow tube 212*a* is provided in a circular tube extending in the flow direction of the refrigerant. Hereinafter, with respect to the flow direction of the refrigerant, one end of the first flow tube 212*a*, which is adjacent to the second muffler 220*a*, is named an inlet, and the other end of the first flow tube 212*a*, which is adjacent to a front end of the piston 130*a*, is named an outlet.

In particular, the diameter d5 of the inlet of the first flow tube 212*a* differs from the diameter d1 of the outlet of the first flow tube 212*a*. In particular, the diameter d5 of the inlet of the first flow tube 212*a* is smaller than the diameter d1 of the outlet of the first flow tube 212*a*. Accordingly, the first flow tube 212*a* has a plurality of variable portions extending from the inlet to the outlet as a whole.

In this case, the outside of the first flow tube 212*a* is provided in a circular tube having a smooth inclined surface. On the other hand, the inside of the first flow tube 212*a* has a plurality of stages. For example, as illustrated in FIG. 9, a case where the inside of the first flow tube 212*a* is provided in five stages will be described.

Hereinafter, the inside of the first flow tube 212*a* is divided into a first stage to a fifth stage sequentially from the outlet to the inlet. In this case, the diameter d1 of the first end corresponds to the diameter of the outlet, and the diameter d5 of the fifth end corresponds to the diameter of the inlet. Thus, the diameter d1 of the first stage is larger than the diameter d5 of the fifth stage.

Further, the diameter becomes smaller as the first flow tube 212*a* goes from the first stage to the fifth stage. That is, the diameter d1 of the first stage>the diameter d2 of a second stage>the diameter d3 of a third stage>the diameter d4 of a fourth stage>the diameter d5 of the fifth stage. Each stage may extend in the flow direction of the refrigerant by a predetermined length.

Referring to FIG. 8, the second muffler 220*a* has a second flow tube 222*a* through which the refrigerant flows, a second coupling portion 224*a* extending from the second flow tube 222*a* to one side, and a second suction portion 226*a*.

The second flow tube 222*a* is provided in a circular tube extending in the flow direction of the refrigerant. Hereinafter, with respect to the flow direction of the refrigerant, one end of the second flow tube 222*a*, which is adjacent to the first muffler 210*a*, is named an inlet, and the other end of the second flow tube 222 is named an outlet. In this case, the diameter of the inlet of the second flow tube 222*a* may be the same as the diameter of the outlet of the second flow tube 222*a*.

In description of flow of the refrigerant in the muffler 200 having the above-described structure, the refrigerant introduced into the third muffler 230*a* passes through the second flow tube 222*a* to flow to the first flow tube 212*a*.

In detail, the refrigerant is introduced into the inlet of the first flow tube 212*a* and is discharged from the outlet of the first flow tube 212*a*. Accordingly, the refrigerant sequentially passes through the fifth stage to the first stage to flow to the front end of the piston 130. In this case, as the diameter of the first flow tube 222*a* through which the refrigerant passes increases, the flow rate of the refrigerant decreases and the pressure of the refrigerant increases.

The refrigerant may flow to the front end of the piston 130 along such a structure at a higher pressure. Accordingly, the suction valve 135 may be opened more quickly and a larger amount of the refrigerant may be introduced into the compression chamber. An exemplary shape of the muffler having the plurality of variable portions has been described, and the muffler may be implemented in more various shapes.

Further, a plurality of through-holes, by which flow noise of the refrigerant is reduced and the pressure of the refrigerant increase, may be provided in the muffler 200 according to the spirit of the present disclosure. Hereinafter, an exemplary shape of the muffler 200 according to the present disclosure will be described with reference to the accompanying drawings. The same contents as the above description will be omitted and the above description will be cited.

Figure 10:
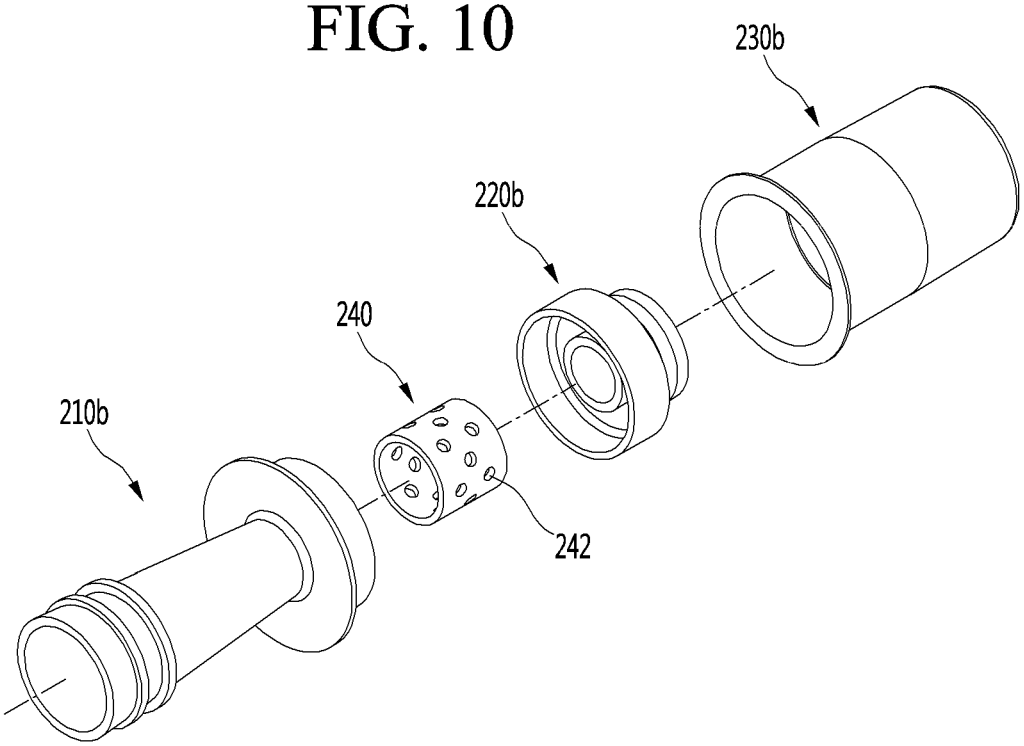
FIG. 10 is an exploded view illustrating a muffler of a compressor according to a third embodiment of the present disclosure.
Figure 11:
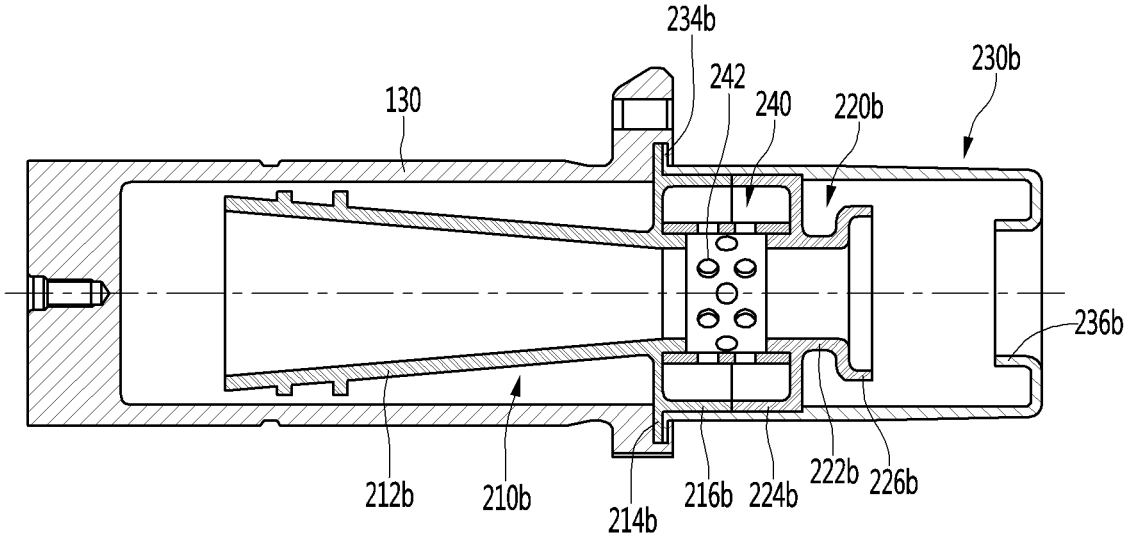
FIG. 11 is a sectional view illustrating a piston and a muffler of a compressor according to the third embodiment of the present disclosure.

FIG. 10 is an exploded view illustrating a muffler of a compressor according to a third embodiment of the present disclosure, and FIG. 11 is a sectional view illustrating a piston and a muffler of a compressor according to the third embodiment of the present disclosure.

As illustrated in FIGS. 10 and 11, the muffler according to the third embodiment of the present disclosure is provided with a plurality of through-holes. In this case, the plurality of through-holes may be formed in a separate configuration constituting the muffler 200.

Referring to FIGS. 10 and 11, the muffler 200 includes the first muffler 210*b*, the second muffler 220*b*, the third muffler 230*b*, and a perforated tube 240.

The perforated tube 240 is provided in a circular tube having a plurality of through-holes 242. Further, the perforated tube 240 has a small thickness and elasticity as compared to the first muffler 210*b*, the second muffler 220*b*, and the third muffler 230*b*.

The size and the number of the through-holes 242 may be different according to the design. Further, the plurality of through-holes 242 may have different sizes. In particular, the size and the number of the through-holes 242 are determined in relation to calculation of a frequency for reducing noise.

Further, the plurality of through-holes 242 may be spaced apart from each other along a circumference of the perforated tube 240 at predetermined intervals. For example, a state in which the plurality of through-holes 242 are formed in three rows along the circumference of the perforated tube 240 is illustrated in FIGS. 10 and 11.

The first muffler 210*b* has a first flow tube 212*b* through which the refrigerant flows, a first coupling portion 214*b* seated on the piston 130, and a first suction portion 216*b* in contact with the second muffler 220*b*. It is illustrated that the first flow tube 212*b* has a variable portion, which is like the first flow tube 212 according to the first embodiment. However, this configuration is merely exemplary, and the first flow tube 212*b* may be provided in various shapes.

The first coupling part 214*b* may extend from the outside of the first flow tube 212*b* radially beyond the inner diameter of the piston 130 and may be seated on one end of the piston 130. That is, the first coupling part 214*b* is formed at a position corresponding to the one end of the piston 130.

Thus, with respect to the first coupling part 214*b*, a front portion of the first flow tube 212*b* including the outlet may be disposed inside the piston 130. Further, the rear portion of the first flow tube 212*b* including the inlet may be coupled to the perforated tube 240.

The second muffler 220*b* has a second flow tube 222*b* through which the refrigerant flows, a second coupling portion 224*b* extending from the second flow tube 222*b* to one side, and a second suction portion 226*b*. It is illustrated that the second flow tube 222*b* is the same as the second flow tube 222*a* according to the second embodiment. However, this configuration is merely exemplary, and the second flow tube 222*b* may be provided in various shapes.

The second coupling portion 224*b* extends radially and forward from the outside of the second flow tube 222*b* to be in contact with the first suction portion 216*b* of the first muffler 210*b*. In this case, with respect to the second coupling part 224*b*, a front portion of the second flow tube 222*b* including the outlet may be coupled to the perforated tube 240.

That is, one end of the perforated tube 240 is coupled to the rear portion of the first flow tube 212*b*, and the other end of the perforated tube 240 is coupled to the front portion of the second flow tube 212*b*. In other words, the perforated tube 240 is coupled to connect the outlet of the second flow tube 222*b* and the inlet of the first flow tube 212*b*.

Further, the perforated tube 240 may be disposed radially inward of the first coupling portion 214*b* and the second coupling portion 224*b*. In particular, the perforated tube 240 may be disposed in a space defined by the first coupling portion 214*b*, the first suction portion 216*b*, and the second coupling portion 224*b*. Thus, the refrigerant may flow from the inside of the perforated tube 240 to the space through the plurality of through-holes 242 or may flow from the space into the perforated tube 240.

In this case, the outlet of the second flow tube 222*b* and the inlet of the first flow tube 212*b* may have the same diameter. Further, the perforated tube 240 may be formed such that the outlet of the second flow tube 222*b* and the inlet of the first flow tube 212*b* have the same diameter.

As illustrated in FIG. 11, the perforated tube 240 may be fitted in the outside of the first flow tube 212*b* and the second flow tube 222*b*. This is exemplary. The perforated tube 240 may be coupled to the inside of the first flow tube 212*b* and the second flow tube 222*b* or may have a predetermined coupling groove corresponding to the first flow tube 212 and the second flow tube 222*b*.

Referring to FIG. 10, in description of assembling of the muffler 200, the perforated tube 240 is fitted in a rear portion of the first muffler 210*b*. Further, the second muffler 220*b* is fitted in the perforated tube 240 and is disposed in contact with the first muffler 210*b*. That is, the first muffler 210*b* and the second muffler 220*b* are in contact with each other such that the perforated tube 240 is located inside the first muffler 210*b* and the second muffler 220*b*. Further, the third muffler 230*b* is in contact with the first muffler 210*b* such that the second muffler 220*b* is located inside the first muffler 210*b* and the third muffler 230*b*.

In description of flow of the refrigerant in the muffler 200 having the above-described structure, the refrigerant introduced into the third muffler 230*b* passes through the second flow tube 222*b*. Further, the refrigerant passes through the perforated tube 240 to flow to the first flow tube 210*b*. In this case, noise of the refrigerant may be reduced through the through-holes 242 of the perforated tube 240.

That is, the perforated tube 240 may be connected to the first flow tube 212*b* and the second flow tube 222*b* to form one flow tube. In other words, it can be understood that the one flow tube including the first flow tube 212*b*, the second flow tube 222*b*, and the perforated tube 240 is provided in the muffler 200. In this case, the flow tube means a predetermined tube extending in a predetermined flow direction such that the refrigerant flows in the flow direction and is provided to the compression space.

In this case, it can be understood that the plurality of through-holes 242 are formed in the one flow tube. Further, the plurality of through-holes 242 may be formed in the one flow tube to be located outside the piston 130. In particular, the plurality of through-holes 242 may be located between the first muffler 210 and the second muffler 220.

Further, as the perforated tube 240 connects the outlet of the second flow tube 222*b* and the inlet of the first flow tube 212*b*, the pressure of the flowing refrigerant may be maintained relatively high. Accordingly, the suction valve 135 may be opened more quickly and a larger amount of the refrigerant may be introduced into the compression chamber.

Further, the muffler 200 may be provided in various forms having a plurality of through-holes. Hereinafter, another exemplary shape of the muffler 200 according to the present disclosure will be described with reference to the accompanying drawings.

Figure 12:
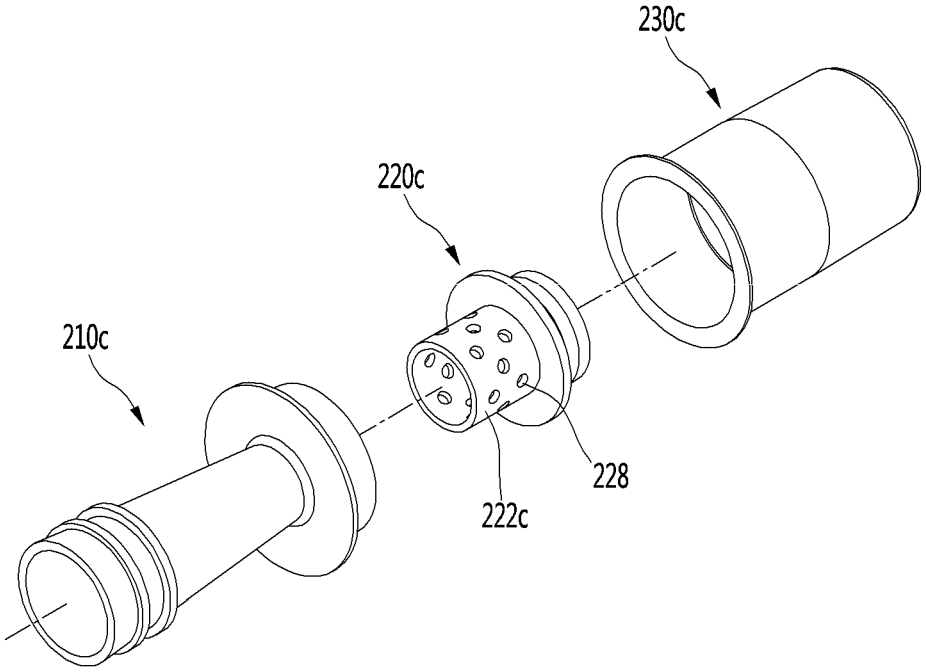
FIG. 12 is an exploded perspective view illustrating a muffler of a compressor according to a fourth embodiment of the present disclosure.
Figure 13:
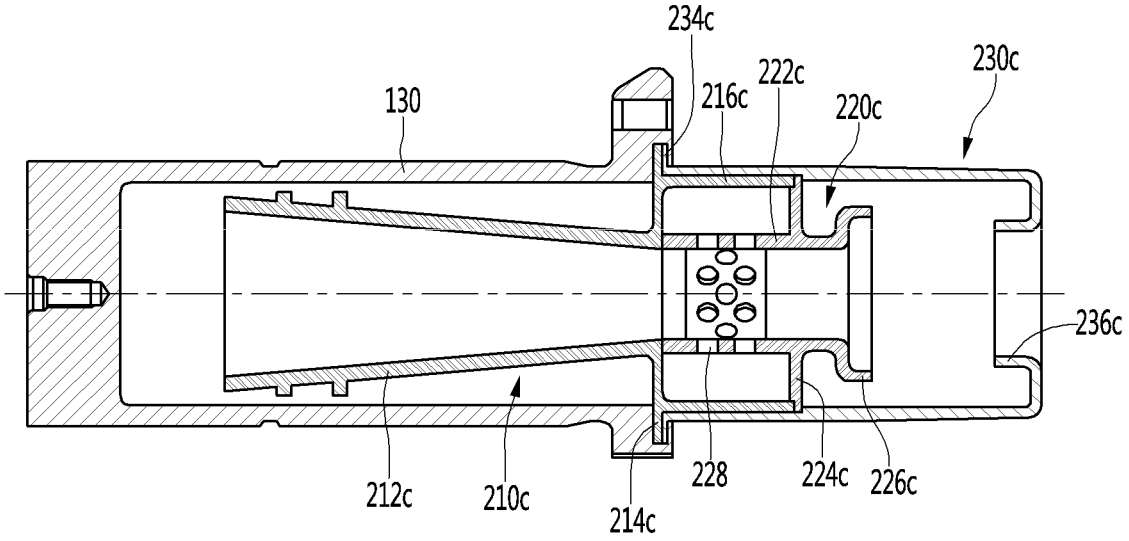
FIG. 13 is a sectional view illustrating a piston and the muffler of the compressor according to the fourth embodiment of the present disclosure.

FIG. 12 is an exploded perspective view illustrating a muffler of a compressor according to a fourth embodiment of the present disclosure, and FIG. 13 is a sectional view illustrating a piston and the muffler of the compressor according to the fourth embodiment of the present disclosure.

As illustrated in FIGS. 12 and 13, the muffler according to the fourth embodiment of the present disclosure is provided with a plurality of through-holes. In this case, the plurality of through-holes may be formed in the second muffler 220*c*.

Referring to FIGS. 12 and 13, the first muffler 210*c* has a first flow tube 212*c* through which the refrigerant flows, a first coupling portion 214*c* seated on the piston 130, and a first suction portion 216*c* in contact with the second muffler 220*c*. It is illustrated that the first flow tube 212*c* has a variable portion, which is like the first flow tube 212 according to the first embodiment. However, this configuration is merely exemplary, and the first flow tube 212*c* may be provided in various shapes.

The first coupling part 214*c* may extend from the outside of the first flow tube 212*c* radially beyond the inner diameter of the piston 130 and may be seated on one end of the piston 130. That is, the first coupling part 214*c* is formed at a position corresponding to the one end of the piston 130.

The first suction portion 216*c* may extend rearward from the first coupling portion 214*c* to be in contact with the second muffler 220*c*. In this case, the first suction portion 216*c* may extend further rearward as compared to the above-described first to third embodiments. Further, the third muffler 230*c* is disposed outside the first suction portion 216*c*.

Referring to FIGS. 12 and 13, the second muffler 220*c* has a second flow tube 222*c* through which the refrigerant flows, a second coupling portion 224*c* extending from the second flow tube 222*c* to one side, and a second suction portion 226*c*.

The second flow tube 222*c* is provided in a circular tube extending in the flow direction of the refrigerant. Hereinafter, with respect to the flow direction of the refrigerant, one end of the second flow tube 222*a*, which is adjacent to the first muffler 210*a*, is named an inlet, and the other end of the second flow tube 222 is named an outlet. In this case, it is illustrated that the diameter of the inlet of the second flow tube 222*c* is the same as the diameter of the outlet of the second flow tube 222*a*, which is exemplary.

Further, the second flow tube 222*c* may extend such that the outlet of the second flow tube 222*c* and the inlet of the first flow tube 212*c* are in contact with each other. That is, the first flow tube 212*b* and the second flow tube 222*c* may be connected to each other to form one flow tube. In other words, it can be understood that the one flow tube including the first flow tube 212*b* and the second flow tube 222*c* is provided in the muffler 200.

In this case, the outlet of the second flow tube 222*b* and the inlet of the first flow tube 212*b* may have the same diameter.

The second coupling portion 224*c* extends radially from the outside of the second flow tube 222*c* to be in contact with the first suction portion 216*c* of the first muffler 210*c*. That is, the first suction portion 216*c* and the second coupling portion 224*c* may be arranged to in contact with each other. Further, the third muffler 230*c* is disposed outside the first coupling portion 224*c*.

In this case, with respect to the second coupling part 224*c*, a plurality of through-holes 228 may be formed in a front portion of the second flow tube 222*c* including the outlet. The size and the number of the through-holes 228 may be different according to the design. Further, the plurality of through-holes 228 may have different sizes. In particular, the size and the number of the through-holes 228 are determined in relation to calculation of a frequency for reducing noise.

In description of flow of the refrigerant in the muffler 200 having the above-described structure, the refrigerant introduced into the third muffler 230*c* passes through the second flow tube 222*c*. In this case, noise of the refrigerant may be reduced through the through-holes 228 formed in the second flow tube 222*c*.

Further, the outlet of the second flow tube 222*c* and the inlet of the first flow tube 212*c* are connected to each other, so that the pressure of the refrigerant passing through the second flow tube 222*c* and the first flow tube 212*c* may be maintained relatively high. Accordingly, the suction valve 135 may be opened more quickly and a larger amount of the refrigerant may be introduced into the compression chamber.

In this way, through the muffler having various shapes, the noise of the refrigerant may be reduced and the pressure may be maintained relatively high. Further, the plurality of variable portions and the through-holes of the above-described muffler may be provided, respectively, or may be provided simultaneously. That is, the muffler having various shapes obtained through various combinations in addition to the shapes illustrated in the drawings may be provided.

What is claimed is:

1. A linear compressor comprising:

a shell;

a cylinder that is located inside of the shell and that defines a compression space;

a piston that is located inside of the cylinder, that is configured to reciprocate relative to the cylinder, and that is configured to compress refrigerant in the compression space; and a muffler that is coupled to the piston and that is configured to guide the refrigerant from an inlet of the muffler toward an outlet of the muffler, wherein the muffler comprises a plurality of flow tubes that extend in a flow direction of the refrigerant from the inlet of the muffler to the outlet of the muffler, wherein at least one of the plurality of flow tubes includes at least one variable portion that has a flow cross-sectional area increasing along the flow direction, wherein the muffler comprises:

a first muffler disposed inside of the piston, and a second muffler coupled to a rear portion of the first muffler, wherein the plurality of flow tubes comprise a first flow tube defining the first muffler and a second flow tube defining the second muffler, wherein each of the first flow tube and the second flow tube defines the at least one variable portion, wherein each of an outer surface of the first flow tube and an inner surface of the first flow tube defines a continuous surface that is inclined with respect to the flow direction and extends from an inlet of the first flow tube to an outlet of the first flow tube, wherein each of an outer surface of the second flow tube and an inner surface of the second flow tube defines a continuous surface that is inclined with respect to the flow direction and extends from an inlet of the second flow tube to an outlet of the second flow tube, wherein the first flow tube and the second flow tube extend in an axial direction of the piston and are spaced apart from each other in the axial direction, and wherein a diameter of the inlet of the first flow tube is greater than a diameter of the outlet of the second flow tube.

2. The linear compressor of claim 1, wherein the muffler further comprises a third muffler that accommodates the second muffler and that is coupled to a rear portion of the piston.

3. The linear compressor of claim 2, wherein the rear portion of the first muffler is accommodated in the third muffler and disposed rearward relative to the rear portion of the piston.

4. The linear compressor of claim 2, wherein the third muffler is disposed outside of the piston.

5. The linear compressor of claim 1, wherein the first muffler comprises:

a first coupling portion that extends radially outward from the first flow tube; and a first suction portion that extends rearward relative to the first flow tube and is in contact with the second muffler.

6. The linear compressor of claim 5, wherein the second muffler comprises a second coupling portion that extends radially outward from the second flow tube and that extends forward to the first suction portion, the second coupling portion being in contact with the first suction portion.

7. The linear compressor of claim 6, wherein the inlet of the first flow tube is a first inlet defined at a first end of the first flow tube, the first inlet facing the second muffler and being located inside of the first suction portion, and wherein the outlet of the first flow tube is a first outlet defined at a second end of the first flow tube opposite to the first end of the first flow tube.

8. The linear compressor of claim 7, wherein the inlet of the second flow tube is a second inlet defined at a first end of the second flow tube, and wherein the outlet of the second flow tube is a second outlet defined at a second end of the second flow tube opposite to the first end of the second flow tube, the second outlet facing the first muffler and being located inside of the second coupling portion.

9. The linear compressor of claim 8, wherein the diameter of the first inlet of the first flow tube is different from a diameter of the first outlet of the first flow tube, and wherein a diameter of the second inlet of the second flow tube is different from the diameter of the second outlet of the second flow tube.

10. The linear compressor of claim 9, wherein the diameter of the first outlet of the first flow tube is greater than the diameter of the first inlet of the first flow tube, wherein the diameter of the second outlet of the second flow tube is greater than the diameter of the second inlet of the second flow tube, and wherein the diameter of the first inlet of the first flow tube is greater than the diameter of the second outlet of the second flow tube.

11. The linear compressor of claim 1, wherein the second muffler is disposed outside of the piston.

12. The linear compressor of claim 1, wherein the second flow tube is disposed outside of the piston.

13. The linear compressor of claim 1, wherein the outlet of the first flow tube faces the piston and defines a maximum diameter of the first flow tube, and wherein the inlet of the first flow tube faces the second flow tube and defines a minimum diameter of the first flow tube.

14. The linear compressor of claim 1, wherein the outlet of the second flow tube faces the first flow tube and defines a maximum diameter of the second flow tube, and wherein the inlet of the second flow tube defines a minimum diameter of the second flow tube.

15. The linear compressor of claim 1, wherein a diameter of the outlet of the first flow tube is greater than the diameter of the inlet of the first flow tube.

16. The linear compressor of claim 15, wherein a diameter of a central region of the first flow tube between the outlet and the inlet of the first flow tube is less than the diameter of the outlet of the first flow tube and greater than the diameter of the inlet of the first flow tube.

17. The linear compressor of claim 16, wherein the diameter of the outlet of the second flow tube is greater than a diameter of the inlet of the second flow tube.

18. The linear compressor of claim 17, wherein a diameter of a central region of the second flow tube between the outlet and the inlet of the second flow tube is less than the diameter of the outlet of the second flow tube and greater than the diameter of the inlet of the second flow tube.

19. The linear compressor of claim 1, wherein a diameter of the outlet of the first flow tube is greater than the diameter of the inlet of the first flow tube, and wherein the diameter of the outlet of the second flow tube is greater than a diameter of the inlet of the second flow tube.

* * * * *